US008182174B2

(12) United States Patent
Tsai

(10) Patent No.: US 8,182,174 B2
(45) Date of Patent: May 22, 2012

(54) DRAINAGE SYSTEM FOR DIRECTING SURFACE WATER TO UNDERGROUND STRATA

(76) Inventor: Yi-Chen Tsai, Chiayi (TW)

( * ) Notice: Subject to any disclaimer, the term of this patent is extended or adjusted under 35 U.S.C. 154(b) by 349 days.

(21) Appl. No.: 12/553,791

(22) Filed: Sep. 3, 2009

(65) Prior Publication Data

US 2011/0052321 A1 Mar. 3, 2011

(51) Int. Cl.
*E02B 11/02* (2006.01)

(52) U.S. Cl. ..... 405/43; 405/41; 405/45; 405/46; 210/170.01

(58) Field of Classification Search ..... 405/36, 405/39, 40, 41, 43, 45, 46, 49, 50; 210/153, 210/163–166, 170.01, 170.03
See application file for complete search history.

(56) References Cited

U.S. PATENT DOCUMENTS

| | | | | | |
|---|---|---|---|---|---|
| 4,204,967 | A * | 5/1980 | Bannister | 210/459 |
| 4,622,138 | A * | 11/1986 | Wager | 405/45 |
| 4,624,603 | A * | 11/1986 | Kanao | 405/49 |
| 4,934,865 | A * | 6/1990 | Varkonyi et al. | 405/50 |
| 4,983,069 | A * | 1/1991 | Florence | 405/43 |
| 4,988,235 | A * | 1/1991 | Hurley | 405/50 |
| 5,017,042 | A * | 5/1991 | Minor et al. | 405/50 |
| 5,190,404 | A * | 3/1993 | Kiyokawa et al. | 405/45 |
| 5,795,100 | A * | 8/1998 | Thomas et al. | 405/45 |
| 7,707,770 | B2 * | 5/2010 | Liu et al. | 47/48.5 |
| 2005/0025573 | A1 * | 2/2005 | Waldman et al. | 405/41 |

FOREIGN PATENT DOCUMENTS

| | | | |
|---|---|---|---|
| JP | 02285115 | A * | 11/1990 |
| JP | 03096511 | A * | 4/1991 |
| JP | 05263414 | A * | 10/1993 |
| JP | 05263415 | A * | 10/1993 |
| JP | 05280030 | A * | 10/1993 |

* cited by examiner

*Primary Examiner* — Tara Mayo-Pinnock
(74) *Attorney, Agent, or Firm* — Frommer Lawrence & Haug LLP; Ronald R Santucci

(57) ABSTRACT

A drainage system includes: at least one first drainage pipe to be disposed within the ground and including a single-piece first porous pipe wall that has a top open end, a bottom open end for extending to a level distant from the ground surface, and a plurality of first through holes to permeate the surface water into adjacent soil areas; and at least one second drainage pipe transversely connected to the first drainage pipe, and including a single-piece second porous pipe wall that has two opposite open ends, and a plurality of second through holes disposed between the two opposite open ends of the second porous pipe wall to permeate the surface water into adjacent soil areas.

15 Claims, 8 Drawing Sheets

DRAINAGE SYSTEM FOR DIRECTING SURFACE WATER TO UNDERGROUND STRATA

BACKGROUND OF THE INVENTION

1. Field of the Invention

This invention relates to a drainage system, more particularly to a drainage system including drainage pipes for directing surface water into soil areas of underground strata.

2. Description of the Related Art

Urbanization has caused replacement of permeable soil with impervious surfaces, such as pavements and buildings, which results in increase in surface runoff when rainwater falls on the impervious surfaces. Surface runoff may cause problems of water accumulation in low-lying land and debris flow. Therefore, a drainage system or a sewer system is required for draining of surface water into rivers or the sea so as to reduce surface runoff.

In addition, since an impervious surface seals a soil surface, and eliminates rainwater infiltration and groundwater recharge, the natural environment is adversely affected, such as the surface temperature adjusted by vegetation and soil is increased.

SUMMARY OF THE INVENTION

Therefore, an object of the present invention is to provide a drainage system for directing surface water into soil areas within the ground.

According to the present invention, a drainage system comprises: at least one first drainage pipe to be disposed within the ground and including a single-piece first porous pipe wall that has a top open end to be disposed near the ground surface for entry of surface water thereinto, a bottom open end for extending to a level distant from the ground surface, and a plurality of first through holes disposed between the top and bottom open ends to permeate the surface water into adjacent soil areas; and at least one second drainage pipe transversely connected to the first drainage pipe, and including a single-piece second porous pipe wall that has two opposite open ends, and a plurality of second through holes disposed between the two opposite open ends of the second porous pipe wall to permeate the surface water into adjacent soil areas.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
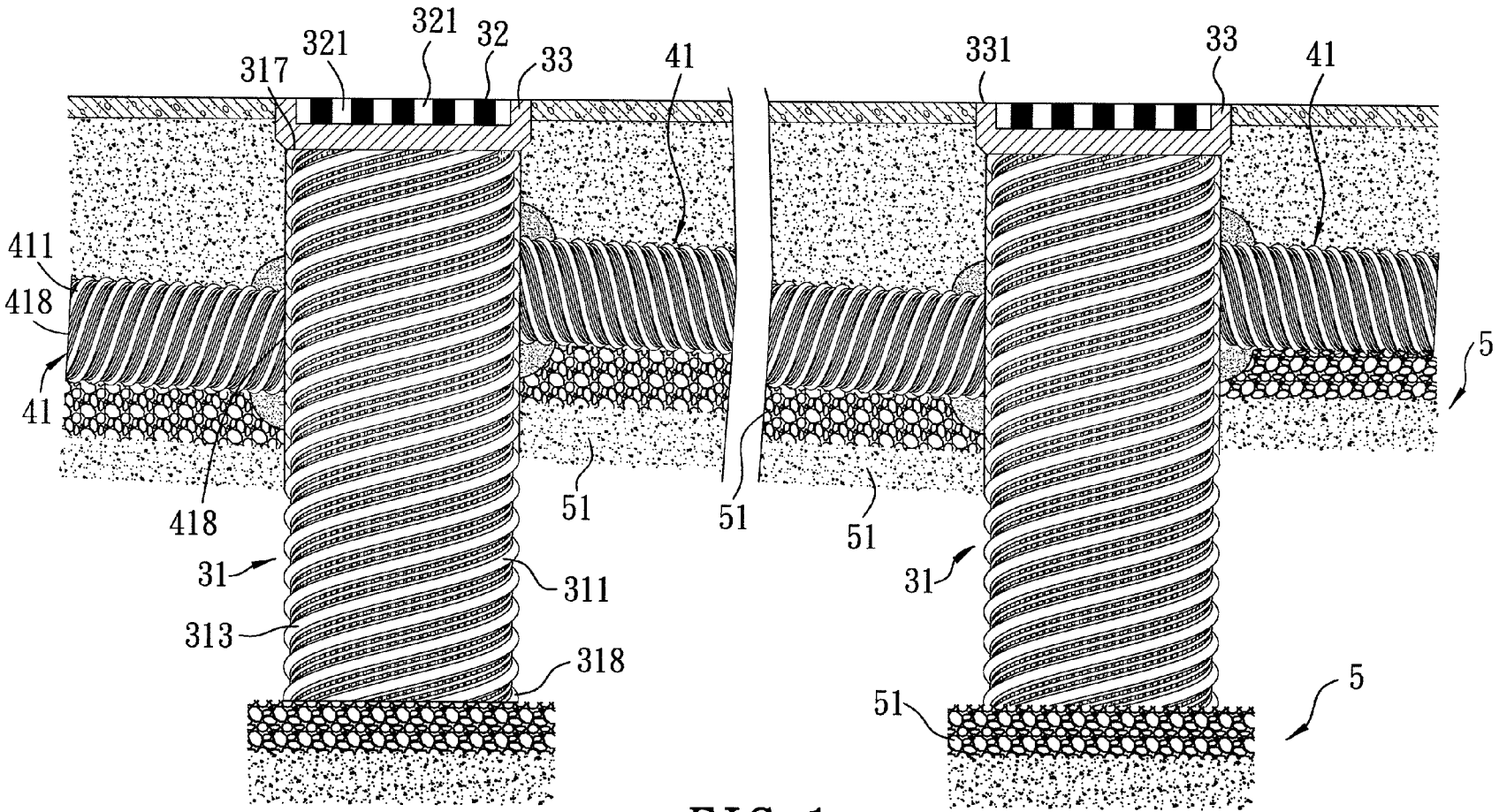
FIG. 1 is a schematic view of the first preferred embodiment of a drainage system according to this invention.

Before the present invention is described in greater detail with reference to the accompanying preferred embodiments, it should be noted herein that like elements are denoted by the same reference numerals throughout the disclosure.

Figure 2:
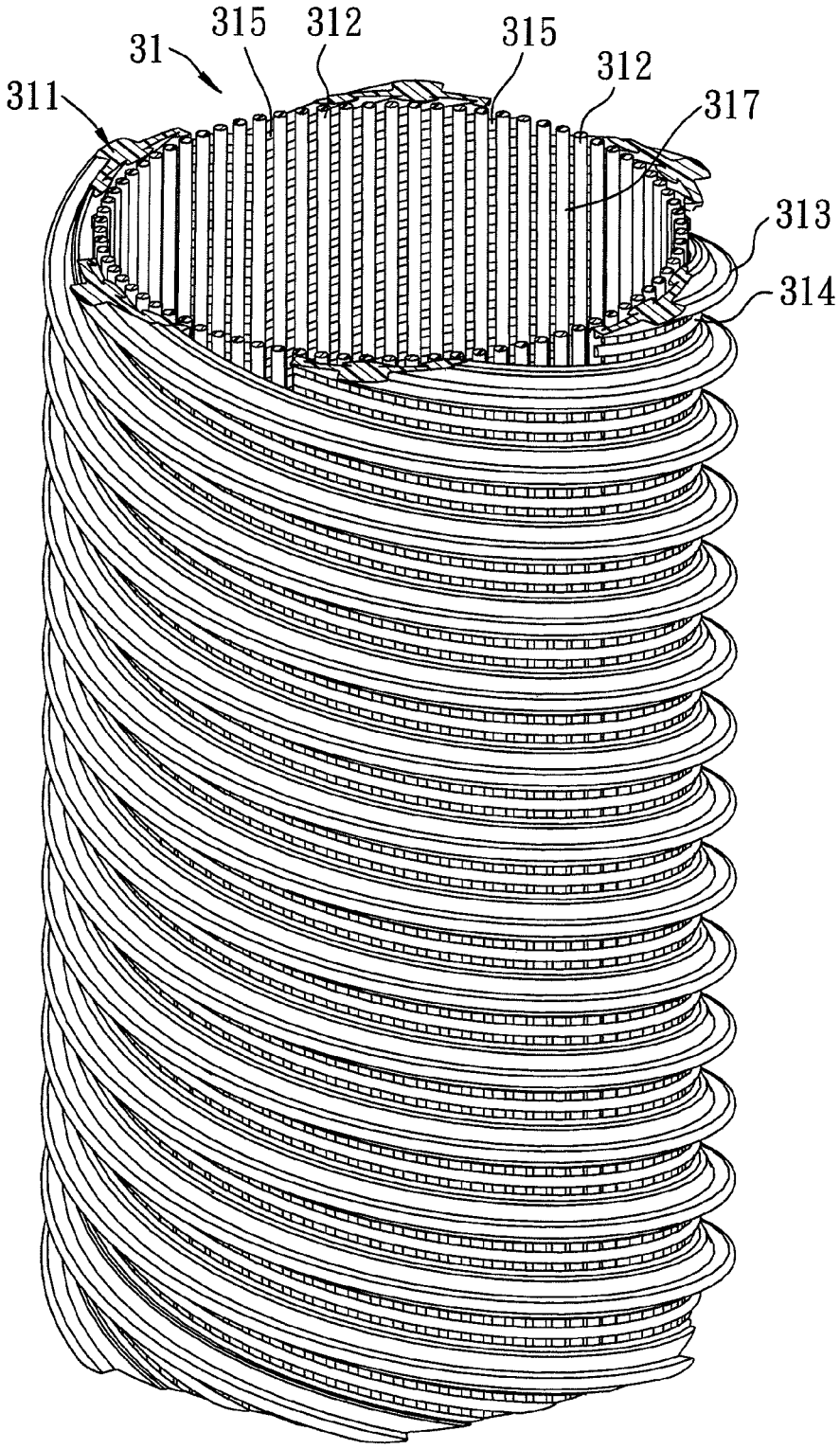
FIG. 2 is a perspective view of the first preferred embodiment illustrating a first drainage pipe.
Figure 3:
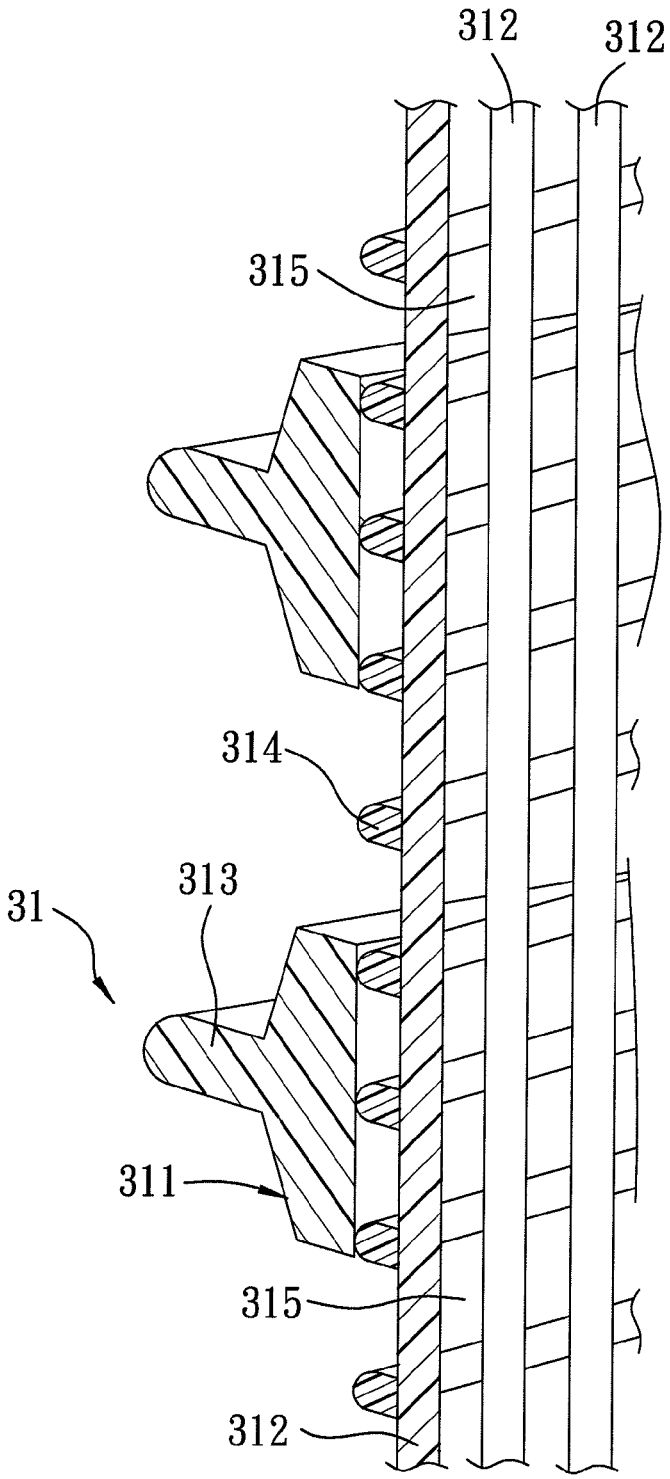
FIG. 3 is a fragmentary sectional view of the first drainage pipe.

Referring to FIGS. 1 to 3, a drainage system of the first preferred embodiment according to this invention includes a plurality of first drainage pipe 31, a plurality of second drainage pipe 41, and a layered filter unit 5, which are to be disposed within the ground.

The drainage system further includes a plurality of water entrance rings 33 (only two are shown in FIG. 1) respectively mounted on top of the first drainage pipes 31, and a plurality of covers 32 (only two are shown in FIG. 1) respectively disposed within the water entrance rings 33.

Each of the first drainage pipes 31 is to be disposed vertically within the ground and includes a single-piece first porous pipe wall 311 that has a top open end 317 to be disposed near the ground surface for entry of surface water thereinto, a bottom open end 318 for extending to a level distant from the ground surface, and a plurality of first through holes 315 disposed between the top and bottom open ends 317, 318 to permeate the surface water into adjacent soil areas. Preferably, the bottom open end 318 of the first porous pipe wall 311 extends to an underground water-bearing stratum.

The first porous pipe wall 311 is made from plastic and further includes a plurality of angularly spaced-apart longitudinal rods 312 that extend along a length of the first porous pipe wall 311, a helical outer rib 314 extending helically around the longitudinal rods 312, and a helical reinforcing rib 313 extending helically around the longitudinal rods 312 and the helical outer rib 314. The longitudinal rods 312 and the helical outer rib 314 of the first porous pipe wall 311 define the first through holes 315. The helical reinforcing rib 313 is thicker than the helical outer rib 314, and has a pitch larger than that of the helical outer rib 314. The reinforcing rib 313 has a T-shaped cross-section and is used to enhance lateral compression strength of the first porous pipe wall 311.

The water entrance rings 33 and the covers 32 are disposed over the top open ends 317 of the first porous pipe walls 311 so as to prevent humans or other animals from falling into the first drainage pipes 31. Each of the covers 32 is formed with a plurality of slots 321 for entry of surface water into the first drainage pipes 31. The water entrance rings 33 are made of cement and have top surfaces 331 flush with the ground surface.

In this embodiment, the first drainage pipes 31 are spaced apart from each other by a distance of 1 m. Each of the first porous pipe walls 311 has a length ranging from 0.8 m to 1 m. In actual applications, the length of the first porous pipe wall 311 may be varied depending on the pervious soil adjacent to the first drainage pipes 31. In this embodiment, the surface water flows into the first drainage pipes 31 through the slots 321 of the covers 32. Alternatively, the surface water can be collected by a concrete culvert before being directed into the first drainage pipes 31.

Figure 4:
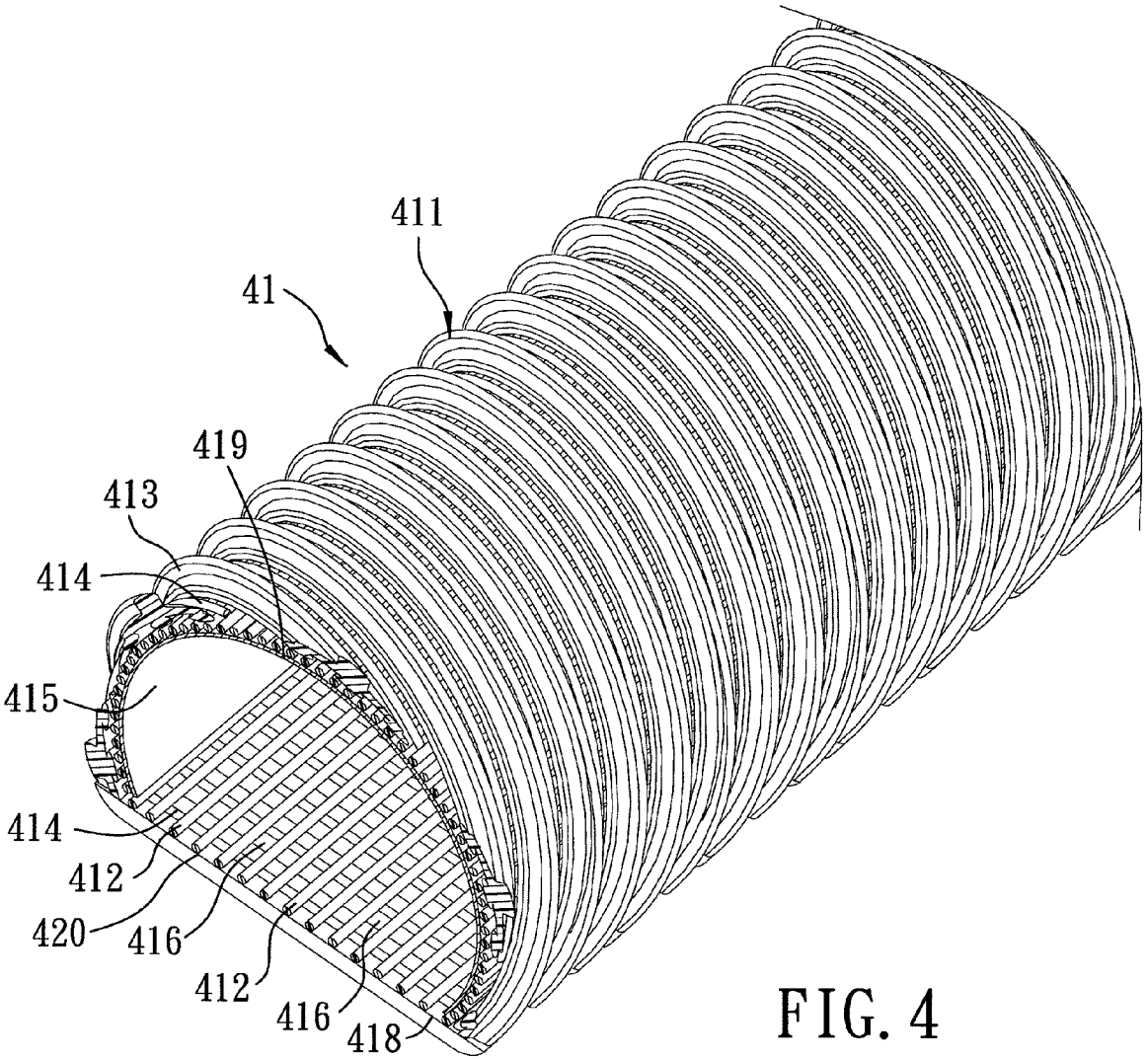
FIG. 4 is a perspective view of the first preferred embodiment illustrating a second drainage pipe.
Figure 5:
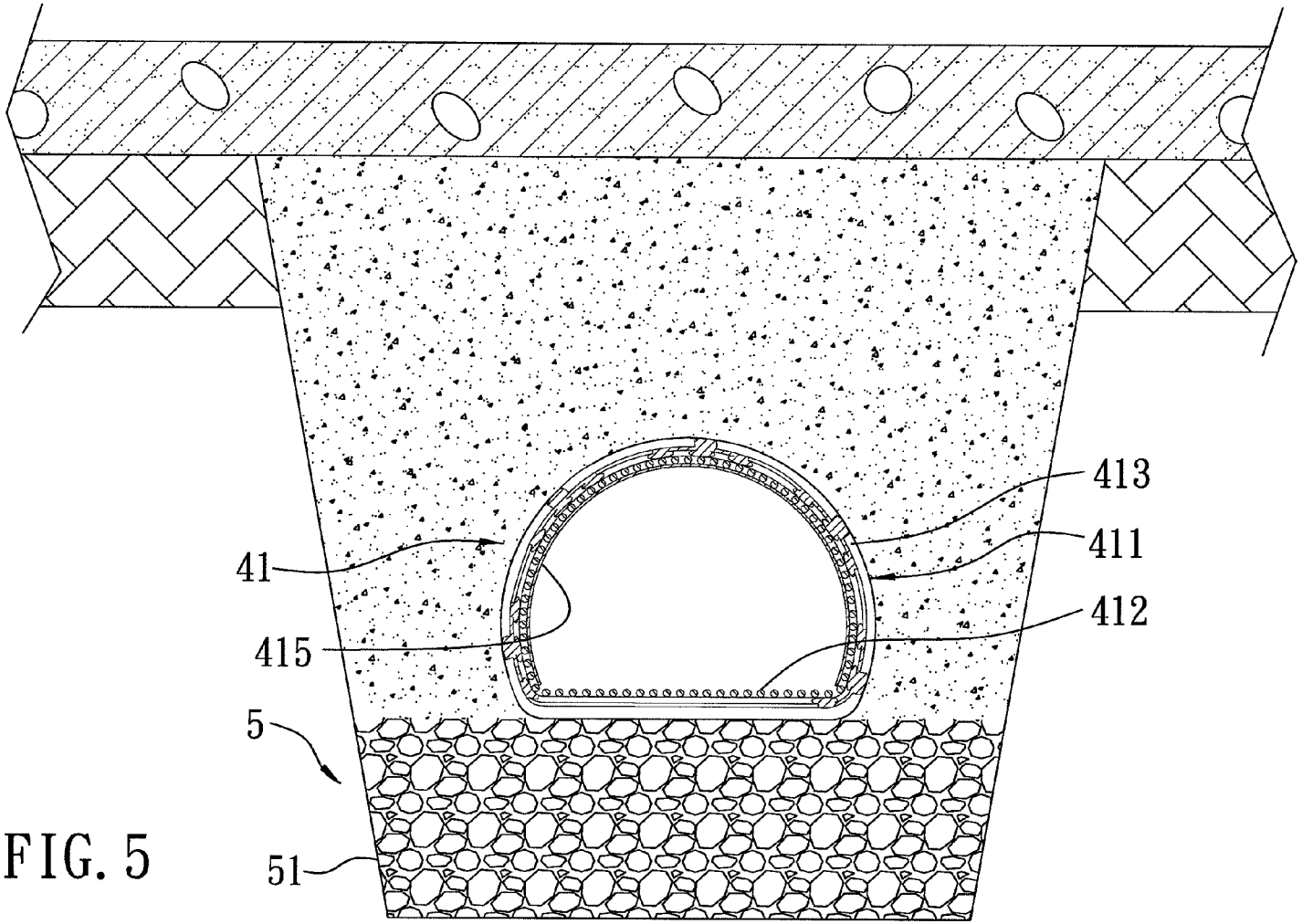
FIG. 5 is a sectional view of the second drainage pipe.

Referring to FIGS. 1, 4 and 5, each of the second drainage pipes 41 has a single-piece second porous pipe wall 411. The second porous pipe wall 411 has two opposite open ends 418 (one is shown in FIG. 4), and a plurality of second through holes 416 disposed between the two opposite open ends 418 to permeate the surface water into adjacent soil areas.

The second porous pipe wall 411 further has a plurality of longitudinal rods 412 that extend along a length of the second porous pipe wall 411, a helical outer rib 414 extending helically around the longitudinal rods 412, and a helical reinforcing rib 413 extending helically around the longitudinal rods 412 and the helical outer rib 414. The helical reinforcing rib 413 is thicker than the helical outer rib 414 and has a pitch larger than that of the helical outer rib 414. The longitudinal rods 412 and the helical outer rib 414 of the second porous pipe wall 411 define the second through holes 416. The reinforcing rib 413 of the second porous pipe wall 411 has a T-shaped cross-section and is used to enhance compression strength of the second porous pipe wall 411.

In this embodiment, the second porous pipe wall 411 is formed with a semicircular cross-section, and further has an upper wall portion 419, and a lower wall portions 420 facing and extending below the upper wall portion 419. The upper wall portion 419 is arcuated and the lower wall portion 420 is substantially flat. Some of the longitudinal rods 412 of the second porous pipe wall 411 are angularly spaced apart from each other to form the arcuated upper wall portion 419, and the remainder of the longitudinal rods 412 of the second porous pipe wall 411 are spaced apart from each other in a direction transverse to the length of the second porous pipe wall 411 to form the flat lower wall portion 420.

The upper wall portion 419 has a blocking member that is formed as a lining layer 415 and that can block solid particulates from entering the second porous pipe wall 411 through the second through holes 416 and therefore prevents accumulation of the solid particulates in the second porous pipe wall 411. The lining layer 415 covers an inner surface of the upper wall portion 419. Preferably, the lining layer 415 is made from a waterproof material.

Figure 6:
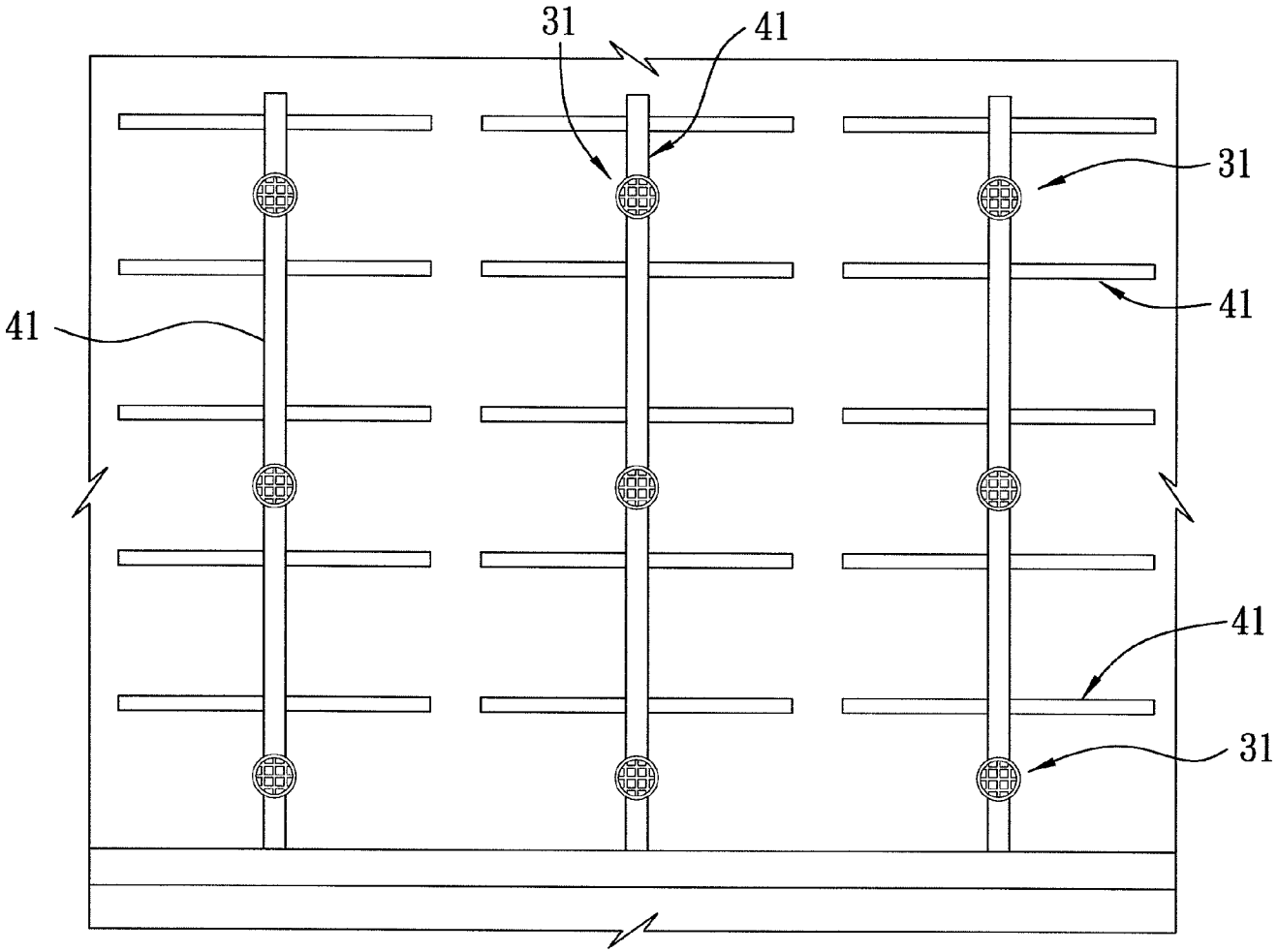
FIG. 6 is a top view of the first preferred embodiment.

Referring to FIGS. 1 and 6, the second drainage pipes 41 are divided into a first group and a second group. Some of the second drainage pipes 41 in the first group are spatially connected to two adjacent ones of the first drainage pipes 31, and the remainder of the second drainage pipes 41 in the first group are connected to one of the first drainage pipes 31. The second drainage pipes 41 in the second group are transversely connected to the first group of the second drainage pipes 41. By virtue of the first and second groups of the second drainage pipes 41, the second drainage pipes 41 are arranged in a network fashion in such a manner that the surface water can be uniformly spread over soil area. In this embodiment, the second drainage pipes 41 are inclined slightly within the ground for directing the surface water toward a desired place.

Referring back to FIG. 1, the layered filter unit 5 is disposed beneath the first drainage pipes 31 and the second drainage pipes 41, and includes a plurality of sand layers 51. Sand particles in the sand layers 51 are reduced in size from a top one to a bottom one of the sand layers 51 to filter out solids from the surface water.

When rainwater falls on impervious surfaces, such as concrete floors or pavements, the water on the surfaces enters the first drainage pipes 31 and flows into the second drainage pipes 41, and then flows out through the first and second through holes 315, 416 into adjacent soil areas. Thereafter, the water flows downward and into the underground water-bearing stratum, thereby reducing surface runoff and preventing accumulation of the surface runoff on the ground surface and debris flow caused by the surface water passing through loose soil structure. In addition, as the surface water can penetrate into the soil areas by virtue of the drainage system, the water content in the soil areas increases, thereby adjusting the surface temperature.

It is worth mentioning that the first and second drainage pipes 31, 41 are formed by a plastic extruding process, which incurs low manufacturing cost. Moreover, during embedment of the first and second drainage pipes 31, 41, concrete and reinforcement rods are not necessary to secure the first and second drainage pipes 31, 41. The layered filter unit 5 and the first and second drainage pipes 31, 41 can be simply installed by excavating trenches or deep holes.

Figure 7:
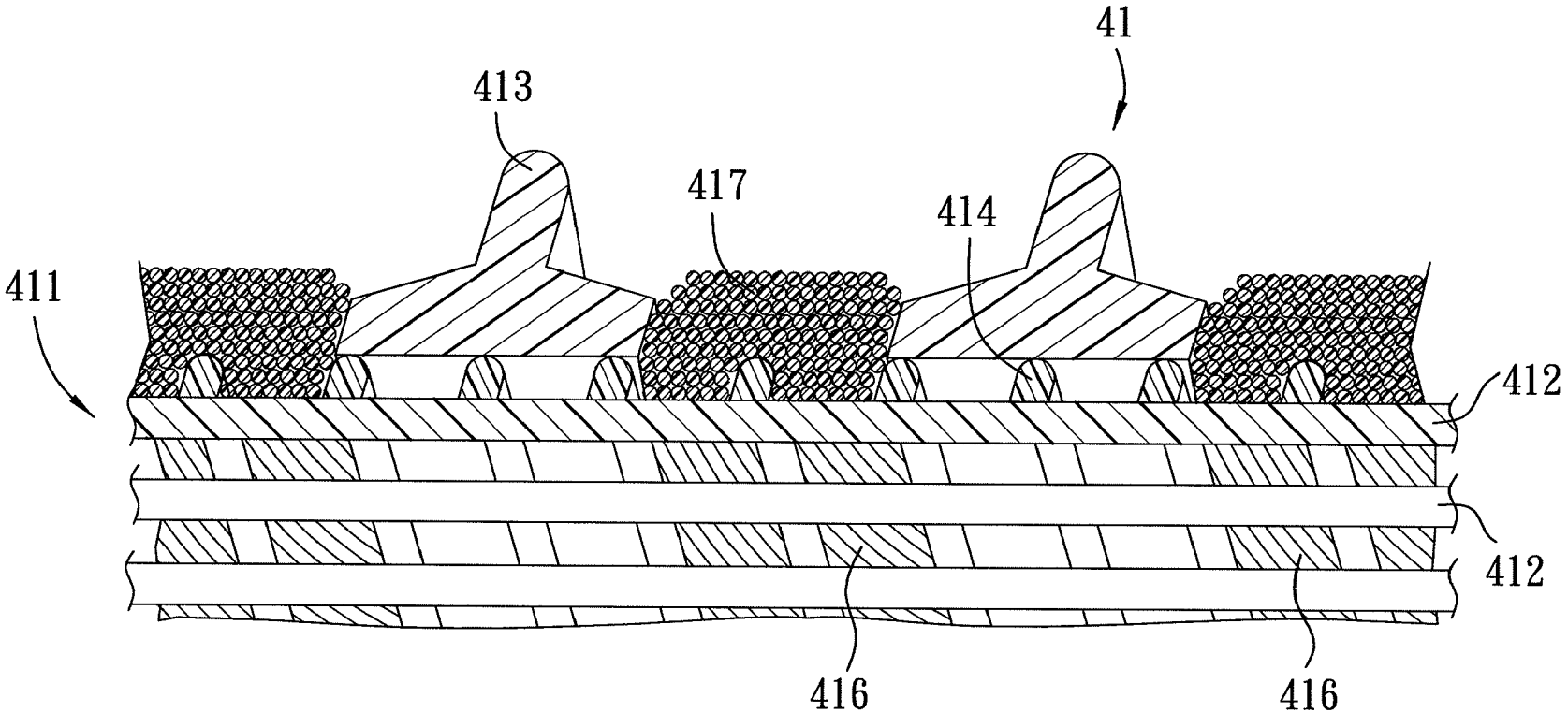
FIG. 7 is a fragmentary sectional view of a second drainage pipe according to the second preferred embodiment of this invention.

Referring to FIG. 7, the second preferred embodiment of the present invention differs from the first preferred embodiment in that the blocking member includes groups of cords 417. Each group of the cords 417 extends around the longitudinal rods 412 and the helical outer rib 414 between two adjacent turns of the helical reinforcing rib 413 of the second porous pipe wall 411. The cords 417 in each group are stacked and juxtaposed for blocking the solid particulates from entering the second drainage pipe 41. However, the cords 417 permit the water to enter the second drainage pipe 41.

Figure 8:
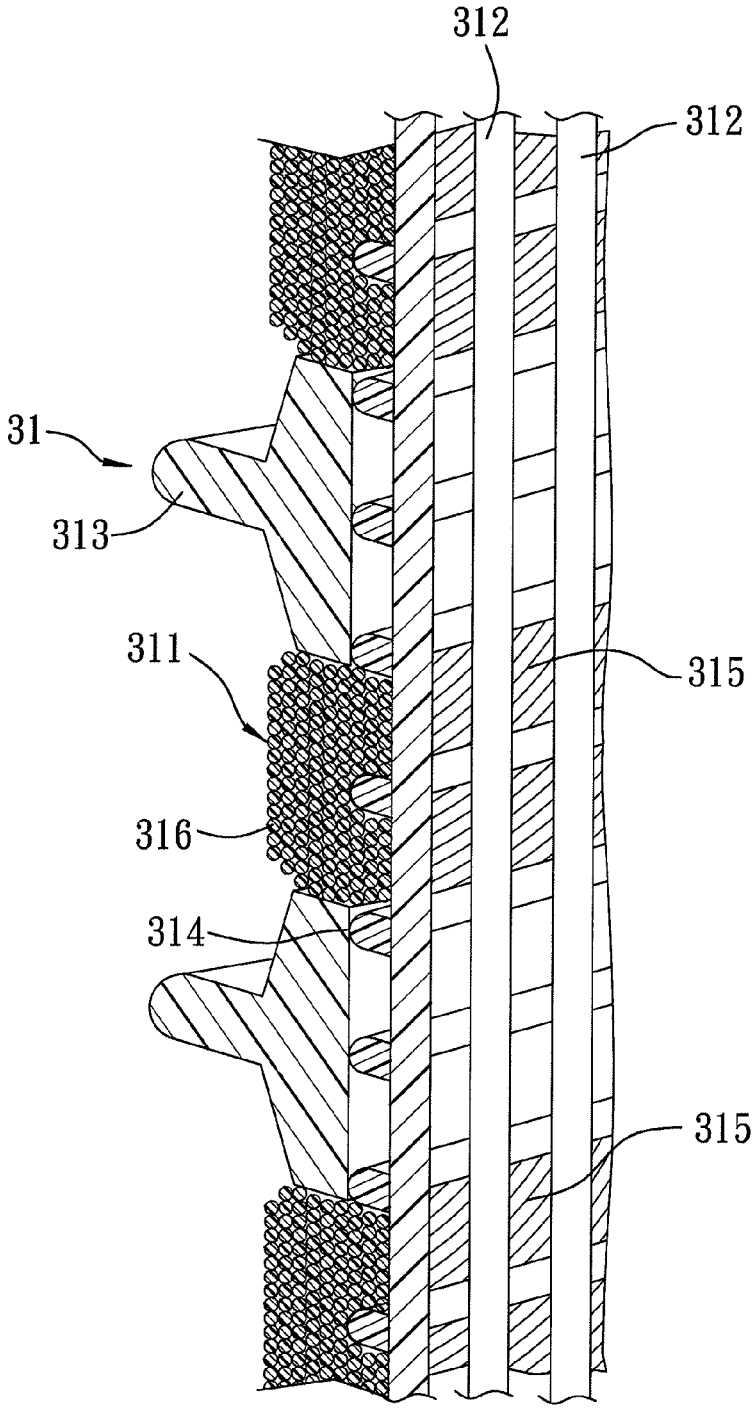
FIG. 8 is a fragmentary sectional view of a first drainage pipe according to the third preferred embodiment of this invention.

Referring to FIG. 8, the third preferred embodiment of the present invention differs from the first preferred embodiment in that the first porous pipe wall 311 further includes groups of cords 316 that extend around the longitudinal rods 312 and the helical outer rib 314 between two adjacent turns of the helical reinforcing rib 313 of the first porous pipe wall 311. The cords 316 in each group are stacked and juxtaposed for blocking the solid particulates from entering the first drainage pipe 31. However, the cords 316 permit the water to enter the first drainage pipe 31.

It is worth mentioning that the groups of cords 417, 316 embodied in the second and third embodiments are optional and may be used depending on actual requirements.

With the invention thus explained, it is apparent that various modifications and variations can be made without departing from the spirit of the present invention. It is therefore intended that the invention be limited only as recited in the appended claims.

What is claimed is:

1. A drainage system comprising:

at least one first drainage pipe to be disposed within the ground and including a single-piece first porous pipe wall that has a top open end to be disposed proximate to the ground surface for entry of surface water thereinto, a bottom open end for extending to a level distant from the ground surface, and a plurality of first through holes disposed between said top and bottom open ends to permeate the surface water into adjacent soil areas; and at least one second drainage pipe transversely connected to said first drainage pipe, and including a single-piece second porous pipe wall that has two opposite open ends, and a plurality of second through holes disposed between said two opposite open ends of said second porous pipe wall to permeate the surface water into adjacent soil areas;

wherein said single-piece second porous pipe wall further has an upper wall portion, and a lower wall portion facing and extending below said upper wall portion, said upper wall portion having a blocking member that blocks solid particulates from entering said second porous pipe wall through said second through holes;

wherein said blocking member includes a lining layer that covers an inner surface of said upper wall portion and that is made from a waterproof material;

wherein said second porous pipe wall is formed with a semicircular cross-section, said upper wall portion being arcuated, said lower wall portion being flat.

2. The drainage system of claim 1, wherein said second porous pipe wall further has a plurality of longitudinal rods that are spaced apart and that extend along a length of said second porous pipe wall, and a helical outer rib extending helically around said longitudinal rods, said longitudinal rods and said helical outer rib defining said second through holes.

3. The drainage system of claim 2, wherein said second porous pipe wall further includes a helical reinforcing rib extending helically around said longitudinal rods and said helical outer rib, said helical reinforcing rib being thicker than said helical outer rib and having a pitch larger than that of said helical outer rib.

4. The drainage system of claim 1, further comprising a layered filter unit which is disposed beneath said first drainage pipe and said second drainage pipe and which includes a plurality of sand layers, sand particles in said sand layers being reduced in size from a top one to a bottom one of said sand layers.

5. The drainage system of claim 1, which comprises a plurality of said first drainage pipes that are spaced apart from each other, and a first group of said second drainage pipes each of which is spatially connected to one of said first drainage pipes.

6. The drainage system of claim 5, which further comprises a second group of said second drainage pipes that are transversely connected to said first group of said second drainage pipes in a network fashion.

7. A drainage system comprising:

at least one first drainage pipe to be disposed within the ground and including a single-piece first porous pipe wall that has a top open end to be disposed proximate to the ground surface for entry of surface water thereinto, a bottom open end for extending to a level distant from the ground surface, and a plurality of first through holes disposed between said top and bottom open ends to permeate the surface water into adjacent soil areas; and at least one second drainage pipe transversely connected to said first drainage pipe, and including a single piece second porous pipe wall that has two opposite open ends, and a plurality of second through holes disposed between said two opposite open ends of said second porous pipe wall to permeate the surface water into adjacent soil areas;

wherein said single-piece second porous pipe wall further has an upper wall portion, and a lower wall portion facing and extending below said upper wall portion, said upper wall portion having a blocking member that blocks solid particulates from entering said second porous pipe wall through said second through holes;

wherein said second porous pipe wall further has a plurality of longitudinal rods that are spaced apart and that extend along a length of said second porous pipe wall, and a helical outer rib extending helically around said longitudinal rods, said longitudinal rods and said helical outer rib defining said second through holes;

wherein said second porous pipe wall further includes a helical reinforcing rib extending helically around said longitudinal rods and said helical outer rib, said helical reinforcing rib being thicker than said helical outer rib and having a pitch larger than that of said helical outer rib;

wherein said blocking member includes groups of cords, each group of said cords extending around said longitudinal rods and said helical outer rib between two adjacent turns of said helical reinforcing rib, said cords in each group being stacked and juxtaposed for blocking the solid particulates.

8. The drainage system of claim 7, wherein said helical reinforcing rib has a T-shaped cross-section.

9. A drainage system comprising:

at least one first drainage pipe to be disposed within the ground and including a single-piece first porous pipe wall that has a top open end to be disposed proximate to the ground surface for entry of surface water thereinto, a bottom open end for extending to a level distant from the ground surface, and a plurality of first through holes disposed between said top and bottom open ends to permeate the surface water into adjacent soil areas; and at least one second drainage pipe transversely connected to said first drainage pipe, and including a single-piece second porous pipe wall that has two opposite open ends, and a plurality of second through holes disposed between said two opposite open ends of said second porous pipe wall to permeate the surface water into adjacent soil areas;

wherein said first porous pipe wall includes a plurality of spaced apart longitudinal rods that extend along a length of said first porous pipe wall, a helical outer rib extending helically around said longitudinal rods, and a helical reinforcing rib extending helically around said longitudinal rods and said helical outer rib, said longitudinal rods and said helical outer rib defining said first through holes, said helical reinforcing rib being thicker than said helical outer rib, and having a pitch larger than that of said helical outer rib;

wherein said first porous pipe wall further includes groups of cords, each group of said cords extending around said longitudinal rods and said helical outer rib of said first porous pipe wall between two adjacent turns of said helical reinforcing rib of said first porous pipe wall, said cords in each group being stacked and juxtaposed for blocking the solid particulates.

10. The drainage system of claim 9, wherein said helical reinforcing rib has a T-shaped cross-section.

11. A drainage pipe comprising a porous pipe wall that includes a plurality of spaced apart longitudinal rods that extend along a length of said porous pipe wall, a helical outer rib extending helically around said longitudinal rods, and a helical reinforcing rib extending helically around said longitudinal rods and said helical outer rib, said longitudinal rods and said helical outer rib defining a plurality of through holes;

wherein said porous pipe wall further includes groups of cords, each group of said cords extending around said longitudinal rods and said helical outer rib between two adjacent turns of said helical reinforcing rib, said cords in each group being stacked and juxtaposed for blocking solid particulates.

12. The drainage pipe of claim 11, wherein said helical reinforcing rib is thicker than said helical outer rib, and has a pitch larger than that of said helical outer rib.

13. The drainage pipe of claim 11, wherein said porous pipe wall further has an upper wall portion, and a lower wall portion facing and extending below said upper wall portion, said upper wall portion having a blocking member that blocks the solid particulates from entering said porous pipe wall through said through holes.

14. The drainage pipe of claim 13, wherein said blocking member includes a lining layer covering an inner surface of said upper wall portion.

15. The drainage pipe of claim 13, wherein said porous pipe wall has a semi-circular cross section.

* * * * *